US007172025B2

(12) United States Patent
Eckerlin

(10) Patent No.: US 7,172,025 B2
(45) Date of Patent: Feb. 6, 2007

(54) SYSTEM FOR LINING A SECTION OF A WELLBORE

(75) Inventor: Jörg Ernst Eckerlin, Rijswijk (NL)

(73) Assignee: Shell Oil Company, Houston, TX (US)

( * ) Notice: Subject to any disclaimer, the term of this patent is extended or adjusted under 35 U.S.C. 154(b) by 387 days.

(21) Appl. No.: 10/493,708

(22) PCT Filed: Oct. 23, 2002

(86) PCT No.: PCT/EP02/11900

§ 371 (c)(1),
(2), (4) Date: Jul. 6, 2004

(87) PCT Pub. No.: WO03/036025

PCT Pub. Date: May 1, 2003

(65) Prior Publication Data

US 2006/0243452 A1 Nov. 2, 2006

(30) Foreign Application Priority Data

Oct. 23, 2001 (EP) ..... 01204032

(51) Int. Cl.
*E21B 17/02* (2006.01)

(52) U.S. Cl. ..... 166/380; 166/207; 175/325.5

(58) Field of Classification Search ..... None
See application file for complete search history.

(56) References Cited

U.S. PATENT DOCUMENTS

| | | | | |
|---|---|---|---|---|
| 341,327 | A | 5/1886 | Fay | |
| 1,981,525 | A | 11/1934 | Price | 166/4 |
| 5,366,012 | A | 11/1994 | Lohbeck | 166/277 |
| 5,613,557 | A | 3/1997 | Blount et al. | 166/277 |
| 6,920,932 | B2 * | 7/2005 | Zimmerman | 166/380 |
| 7,032,679 | B2 * | 4/2006 | Maguire et al. | 166/380 |
| 7,090,025 | B2 * | 8/2006 | Haugen et al. | 166/384 |
| 2001/0002626 | A1 | 6/2001 | Frank et al. | 175/57 |

FOREIGN PATENT DOCUMENTS

| | | |
|---|---|---|
| EP | 0360319 | 3/1990 |
| EP | 0899420 | 3/1999 |
| EP | 01097760 | 5/2001 |
| GB | 2344606 | 6/2000 |
| WO | 00/77431 | 12/2000 |

OTHER PUBLICATIONS

International Search Report dated Jan. 2, 2003.

* cited by examiner

*Primary Examiner*—Frank S. Tsay
(74) *Attorney, Agent, or Firm*—Rachael A. Stiegel

(57) ABSTRACT

A system for lining a section of a wellbore with an expandable tubular element is provided. The system includes an elongate string extending into the wellbore, the string being provided with the tubular element in the unexpanded form thereof whereby the tubular element surrounds a lower portion of the string. The string is further provided with an expander arranged at a lower end part of the tubular element and anchoring means for anchoring an upper end part of the tubular element in the wellbore.

11 Claims, 4 Drawing Sheets

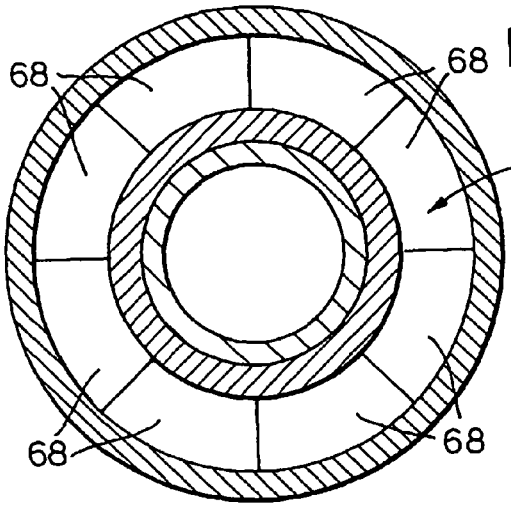
Fig.4.
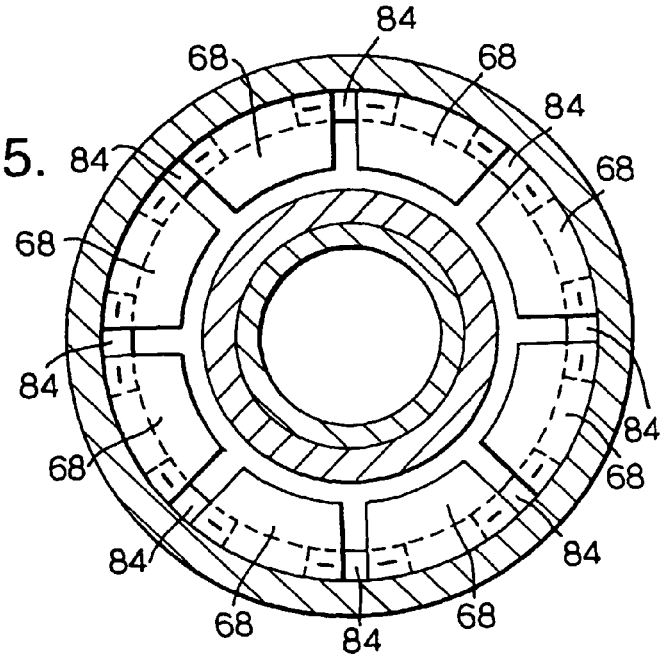
Fig.5.
Fig.6.
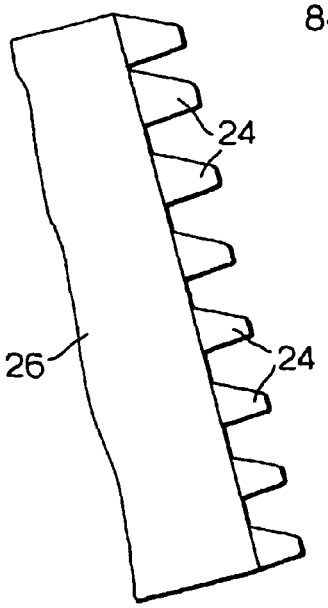

SYSTEM FOR LINING A SECTION OF A WELLBORE

FIELD OF THE INVENTION

The present invention relates to a system for lining a section of a wellbore with an expandable tubular element, whereby an elongate string extends into the wellbore. An example of such string is a drill string used to drill wellbore.

BACKGROUND OF THE INVENTION

During conventional wellbore drilling sections of the wellbore are drilled and provided with a casing or a liner in subsequent steps. In each step, the drill string is lowered through the casings already installed in the wellbore, and a new section is drilled below the installed casings. By virtue of this procedure, casing which is to be installed in the newly drilled section has to pass through earlier installed casing, therefore the new casing must be of smaller outer diameter than the inner diameter of the earlier installed casing. As a result the available diameter of the wellbore becomes smaller with depth. For deep wells, this consequence can lead to impractically small diameters.

In the description below, references to "casing" and "liner" are made without an implied difference between such types of tubulars. Similarly, references to "lining" can be understood to mean: providing a liner or a casing in the wellbore.

It has been proposed to overcome the problem of stepwise smaller inner diameters of wellbore casing by installing a tubular element in a wellbore and thereafter radially expanding the tubular element to a larger diameter by means of an expander which is pulled, pushed or pumped through the tubular element. However, such method requires that the drill string is to be removed from the wellbore each time a new expandable tubular element is installed in the wellbore.

SUMMARY OF THE INVENTION

In accordance with the invention there is provided a system for lining a section of a wellbore with an expandable tubular element, comprising an elongate string extending into the wellbore, said string being provided with the tubular element in the unexpanded form thereof whereby the tubular element surrounds a lower portion of the string, the string further being provided with an expander arranged at a lower end part of the tubular element and anchoring means for anchoring an upper end part of the tubular element in the wellbore.

In use the expandable tubular element (e.g. a liner or a casing section) is initially supported on the drill string, and at the desired depth expanded against the borehole wall for its permanent installation in the wellbore by first anchoring the upper end part against the inside of the existing casing, wellbore wall or other tubular element, and then pulling the expander upwards through the tubular element. Thereafter the drill string can be retrieved to surface completely. By this method the drill string with the expandable tubular element thereon can be operated to drill the wellbore like is normally done when drilling wells in the ground without having less strength. In the unexpanded state of the expandable tubular element the entire drill string can be pulled to surface to exchange worn parts, should this become necessary. The method can be repeated to drill another new hole section below the previously expanded tubular element. The expanded element may be additionally sealed inside the borehole by pumping a hardening fluid into any remaining annular space between the expanded element and the borehole wall.

BRIEF DESCRIPTION OF THE DRAWINGS

The invention will be described hereinafter in more detail and by way of example with reference to the accompanying drawings in which:

FIG. 4 schematically shows section 4—4 of FIG. 3A;

FIG. 5 schematically shows section 5—5 of FIG. 3B; and

FIG. 6 schematically shows a detail of the expander of FIGS. 2A and 2B.

Figure 1:
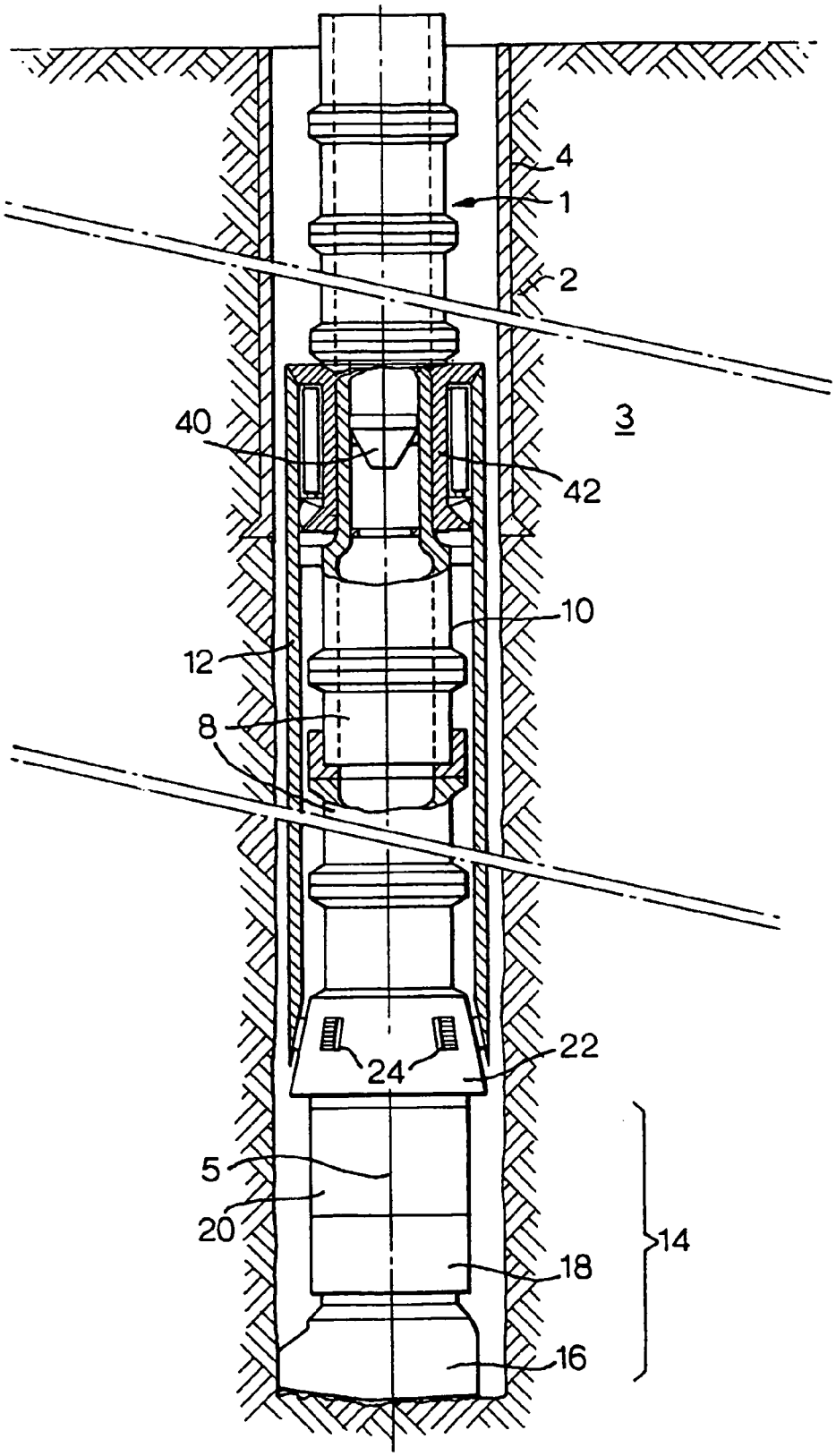
FIG. 1 schematically shows a longitudinal view, partly in section, of an embodiment of the system of the invention.

For the purpose of simplicity, in FIGS. 2A, 2B, 3A, 3B is shown only one half of the respective longitudinal section, the other half being symmetrical thereto with respect to the longitudinal axis (indicated by reference numeral 5).

In the Figures, like reference numerals relate to like components.

DESCRIPTION OF THE EMBODIMENT

In FIG. 1 is shown a tubular drill string 1 extending into a wellbore 2 formed in an earth formation 3. An upper section of the wellbore 2 is provided with a casing string 4 having longitudinal axis 5. A newly drilled open hole section 6 which has not yet been provided with casing extends below the casing string 4. The drill string 1 includes a plurality of jointed drill string sections 8 (e.g. sections of drill pipe) and has a lower portion 10 around which an expandable tubular liner 12 is substantially concentrically arranged. A lower end part of the drill string 1, i.e. below the liner 12; is formed by a bottom hole assembly (BHA) 14 which includes a drill bit 16 of bi-centred or eccentric type, a drilling motor 18 for driving the drill bit 16, and a measurement while drilling tool (MWD) 20 to aid in the process of directional drilling of the wellpath to a particular subsurface location. On top of the MWD tool 20 other components which are normally used in drilling of wells can be included. A characteristic of the bi-centred drill bit 16 is that it drills borehole sections of a larger diameter than its own diameter as the bit, when rotated, describes a larger circular area than when not rotated. The drill string 1 is further provided with an expansion cone 22 arranged on top of the BHA 10, for expanding the liner 12 through plastic deformation by moving the expansion cone 22 through liner 12. The lower portion 10 of the drill string 1 includes an axial extension sub 23 which allows the drill string 1 to slide a short distance axially relative to the liner 12 in order to compensate for differential thermal expansion of the drill string 1 and the liner 12.

Figure 2A:
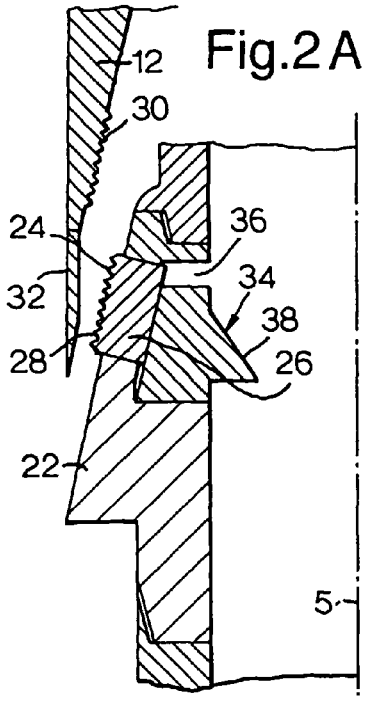
FIG. 2A schematically shows a longitudinal section of an expander applied in the embodiment of FIG. 1, when secured to the lower end of the string.
Figure 2B:
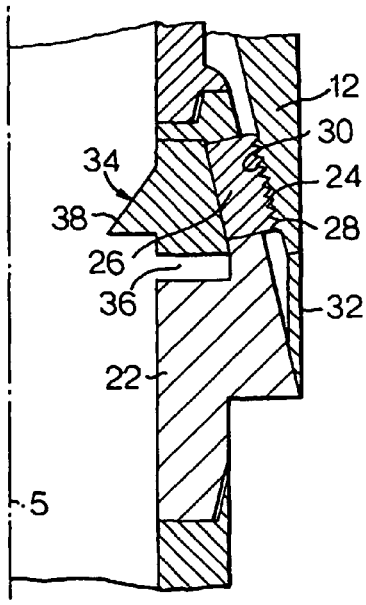
FIG. 2B schematically shows a longitudinal section of the expander of FIG. 2B when released from the string.

Referring further to FIGS. 2A and 2B, the expansion cone 22 is provided with releasable support means for supporting the liner 12, which support means includes a plurality of retractable holding blocks 24 circumferentially spaced along the outer surface of the cone 22 and positioned in respective holes 26 arranged in the conical outer surface of the expansion cone 22. The holding blocks 24 form with their combined outside surfaces a thread pattern 28 like a buttress thread, which thread pattern engages with a complementary buttress like thread pattern 30 on the bottom end of the liner 12. Engagement of the thread pattern 28 with the thread pattern 30 is accomplished by sliding the lower end of the liner 12 with the thread pattern 30 over the thread pattern 28 of the retractable holding blocks 24. In the process of engagement the liner 12 can only move downwards and not upwards. The lower end of the liner 12 can alternatively be screwed onto the holding blocks 24, whereby the preferred threading direction is counter clockwise. A protection sleeve 32 is attached to the lower end of the liner 12 to prevent damage to the outer surface of the expansion cone 22.

The expansion cone 22 is at its inner surface provided with a ring 34 arranged in an annular recess 36 of the cone 22 in a manner that the ring is axially slideable in the annular recess 36. As is evident from FIGS. 2A, 2B, the holes 26 are in fluid communication with the annular recess 36, and the ring 34 and the holding blocks co-operate in a manner that downward sliding of the ring causes radial retraction of the holding blocks 24. The ring has a landing profile 38 which matches a closing plug 40 (shown in FIGS. 1, 3A, 3B) which can be pumped through the drill string 1. When the closing plug 40 seats on the landing profile 38, the fluid circulating passage through the drill string 1 is blocked. Continued pumping of fluid through the string 1 causes the fluid pressure above the closing plug 40 to rise and thereby to slide the ring 34 downwards. As a result the holding blocks 24 are allowed to retract radially inward so that thereby the expansion cone 22 is released from the liner 12.

Figure 3A:
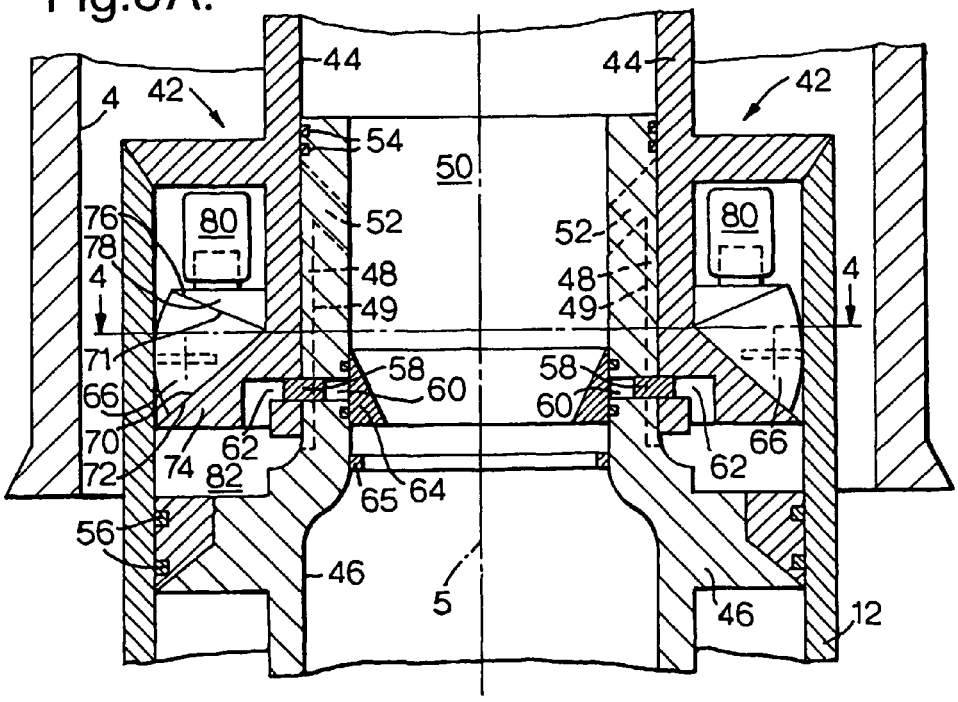
FIG. 3A schematically shows a longitudinal section of an anchoring system applied in the embodiment of FIG. 1, before activation thereof.
Figure 3B:
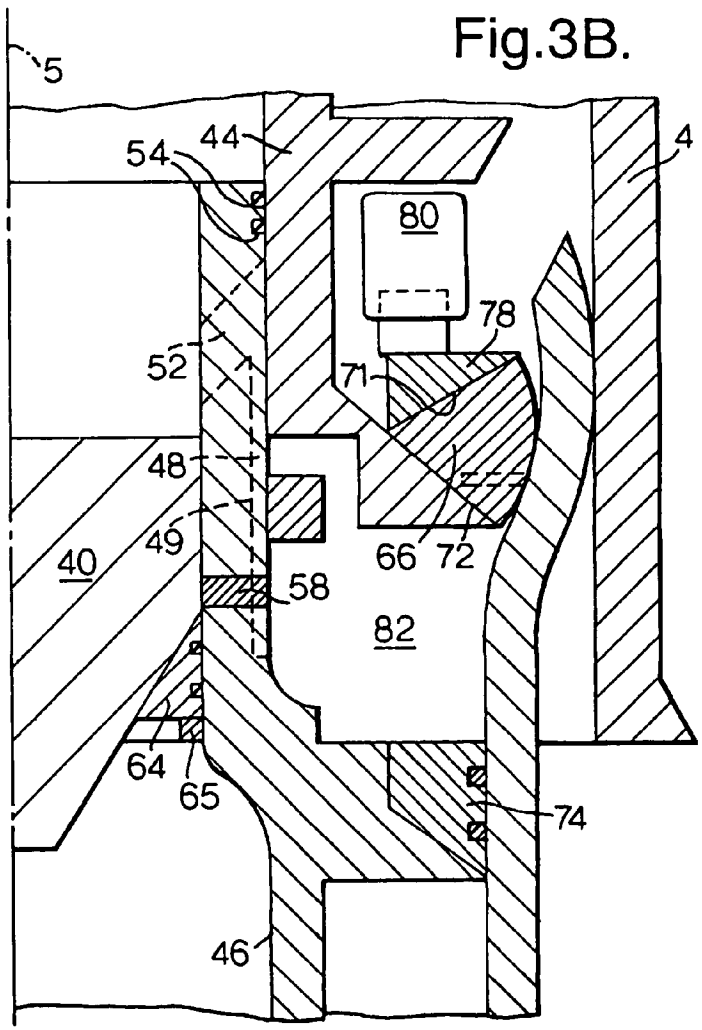
FIG. 3B schematically shows a longitudinal section of the anchoring system of FIG. 3B during an initial stage of activation thereof.

Referring is further made to FIGS. 3A and 3B. The drill string 1 includes an expansion device 42 arranged at the upper end of the liner 12, for radially expanding the liner 12 against the casing 4 so as to form a firm connection and fluid seal with the casing 4. The expansion device 42 includes respective upper and lower tubular members 44, 46 which are axially movable relative to each other by virtue of a spline arrangement 48 capable of transmitting torque between the members 44, 46. Small clearances between the splines of the two members 44, 46 define a plurality of small longitudinal fluid passages 49 of which some are in fluid communication with the interior 50 of the drill string 1 via openings 52 provided in the lower member 46. The outer surface of the lower member 46 is sealed against the inner surface of the upper member 44 by annular seals 54 arranged above the openings 52. The lower member 46 is sealed against the liner 12 by annular seals 56.

The two members 44, 46 are locked to each other by a locking ring 58 which is arranged in an annular recess 60 of the lower member 46, and which extends into an annular recess 62 of the upper member 44 so as to transmit axial loads between the two members 44,46. The locking ring 58 is spring loaded so as to retract fully into the annular recess 60 when released. A split seating ring 64 is arranged in the lower member 46 at the level of the annular recess 60 so as to close-off the recess 60, the seat ring 64 being axially slideable relative to lower member 46. The portion of the recess 60 between the seat ring 64 and the locking ring 58 is filled wit an incompressible fluid. A stop ring 65 is fixedly connected to the inner surface of the lower member 46, a suitable distance below the annular recess 60.

Referring further to FIGS. 4 and 5, the upper member 44 is provided with an expandable ring-shaped mandrel 66 which is circumferentially divided into a plurality of mandrel segments 68 so as to allow the mandrel 66 to be operable between a radially retracted mode (as shown in FIG. 4) in which adjacent segments are in abutment, and a radially expanded mode (as shown in FIG. 5) in which adjacent segments are circumferentially separated from each other. The mandrel 66 has a lower surface 70 (FIG. 3A, 3B) which tapers downwardly in radial outward direction, and an upper surface 71 which tapers upwardly in radial outward direction. The lower surface 70 is arranged in contact with a complementary frustoconical surface 72 of a first annular actuator 74 which forms an integral part of the upper member 44. The upper surface 71 is arranged in contact with a complementary frustoconical surface 76 of a second annular actuator 78 which is pushed against the mandrel by a spring device 80. By this arrangement the mandrel 66 is moved to its radially expanded mode when the upper member 44 moves upwardly relative the lower member 46. A fluid chamber 82 is formed between the first actuator 74 and the lower member 46, which chamber 82 is in fluid communication with the interior 50 of the drill string 1 via the small fluid passages 49 and the openings 52. Thus, when drilling fluid is pumped from the interior 50 of the drill string 1 via openings 52 and fluid passages 49, into the fluid chamber 82, the upper member 44 is induced to move upwardly relative the lower member 46. The mandrel 66 has a radial outer surface of a similar quality to the outer surface of the expansion cone 22. The segments 68 are interconnected by linking elements 84 (FIG. 5) which also serve to cover the gaps formed between the segments 68 as these move radially outwards. The gaps can also be covered by selected intermeshing profiles of the segments 68.

During normal operation the new open hole section 6 is drilled below casing 4, whereby the drill string 1 is lowered through the casing 4. The bi-centred drill bit 16 drills the new borehole section 6 to a diameter which is about equal to the diameter of the upper borehole section 2. During drilling a stream of drilling fluid is pumped through the interior passage 50 of the drill string 1. After section 6 has been drilled, the drill string 1 is positioned such that an upper end portion of the liner 12 is located inside the casing 4. Subsequently the closing plug 40 is pumped together with the stream of drilling fluid into the drill string 1 until the plug 40 becomes seated on the seating ring 64. Thereby the closing plug 40 blocks the fluid passage 50, and continued pumping of fluid into the drill string 1 causes the seat ring 64 to slide downwards against the stop ring 65. Through this movement the openings 52 become unsealed and the uncompressible medium is pushed out by the locking ring 58 which fully retracts into the annular recess 60. Thus, the upper member 44 becomes unlocked from the lower member 46.

Figure 3C:
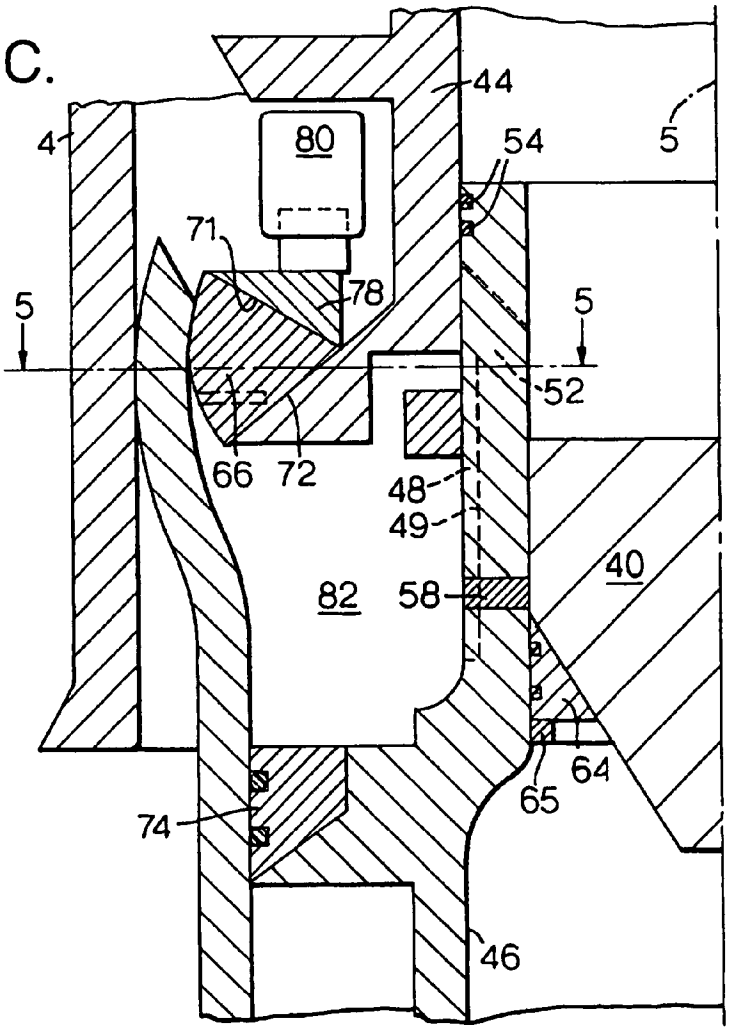
FIG. 3C schematically shows a longitudinal section of the anchoring system of FIG. 3B during a subsequent stage of activation thereof.

Drilling fluid which enters the fluid chamber 82 via openings 52 and fluid passages 49 causes the fluid chamber 82 to act as a hydraulic piston/cylinder assembly whereby the upper member 44 is pushed upwardly relatively the lower member 46. The mandrel 66 is thereby subjected to an upward force at its lower tapering surface 72 from the upper member 44, and to a downward reaction force at its upper tapering surface 71 from spring device 80. As a result the mandrel segments 68 are pushed radially outward so that the mandrel 66 moves to its radially expanded mode (FIG. 3B) whereby the upper end part of the liner 12 plastically deforms and becomes radially expanded against the casing 4. Then the upper member 44 continues to being pushed upwards thereby expanding the remaining upper end of the liner 12 (FIG. 3C). When the upper end of the liner 12 is fully expanded against the existing casing 4, the upper member 44 reaches a stop (not shown) to limit further travel. As a result the upper end of the liner 12 becomes firmly anchored against the casing 4.

Next, the closing plug 40 is released from the seating ring 64 by applying increased pumping pressure so that stop ring 65 breaks and the seating ring 64 is allowed to slide further downwards into an axial position where it can expand to a larger diameter. The closing plug 40 is pumped further down the drill string 1 until it seats on landing profile 38 of ring 34. Continued pumping of drilling fluid through the drill string 1 causes the ring 34 to slide downwards in annular recess 36, and thereby causes the holding blocks 24 to radially retract. In this manner the expansion cone 22 becomes released from the liner 12.

In a next step the drill string 1 with the expansion cone 22 is pulled upwards through the liner 12 whereby the liner 12 is restrained against axial movement by virtue of its anchored upper end part. By pulling the expansion cone 22 through the liner 12, the liner 12 is expanded to an outer diameter almost equal to the diameter of the wellbore 2.

The wall thickness of the upper end of liner 12 can be different, especially smaller, from the wall thickness of the remainder of the liner 12 to reduce the force required to expand the liner.

Instead of a bi-centred drill bit, an underreamer or an expandable bit can be used.

The expandable tubular liner can have a predetermined length which is longer than the initially planned newly drilled hole section such that there is an overlap with the existing casing. The expandable liner can be installed at any other intermediate depth should this become necessary.

The expandable liner may contain preformed holes which are closed in the unexpanded stage and which open up during expansion to allow pumping of a hardening fluid into the annular space between the expanded liner and the borehole wall.

Instead of applying the spring device 80 to provide a downward reaction force to the second annular actuator 78 in response to upward movement of the upper member 44 against the mandrel 66, a hydraulic piston/cylinder assembly can be applied to provide a downward reaction force to the second annular actuator 78. Such piston/cylinder assembly is suitably powered by hydraulic fluid pressure from fluid present in the interior 50 of the drill string 1.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A system for lining a section of a wellbore with an expandable tubular element, comprising an elongate string extending into the wellbore, said string being provided with the tubular element in the unexpanded form thereof whereby the tubular element surrounds a lower portion of the string, the string further being provided with an expander arranged at a lower end part of the tubular element and anchor for anchoring an upper end part of the tubular element in the wellbore, wherein said upper end part of the tubular element extends into an outer tubular element arranged in the wellbore and surrounding said upper end part, and wherein the anchor includes radial expansion means for radially expanding the upper end part of the tubular element against the outer tubular element.

2. The system of claim 1, wherein the tubular element is supported by the string by a releasable support.

3. The system of claim 2, wherein the releasable support comprises at least one holding device provided to the string, each holding device being movable between a radially retracted mode in which the string is axially movable relative to the tubular element and a radially extended mode in which the holding device supports the tubular element.

4. The system of claim 3, wherein the string is provided with a longitudinal fluid passage for wellbore fluid and an annular seat arranged in the fluid passage, said annular seat being axially movable relative to the string and being operable so as to move each holding device from the extended mode to the retracted mode thereof upon the seat being axially moved by a plug pumped through the fluid passage.

5. The system of claim 4, wherein said fluid passage continues through the expander, and wherein each holding device is arranged at the level of the expander.

6. The system of claim 5, wherein the outer tubular element is one of a wellbore casing, a wellbore liner and a tubular patch.

7. The system of claim 1, wherein the radial expansion means comprises a mandrel formed of a plurality of radially movable mandrel segments.

8. The system of claim 7, wherein the mandrel is arranged to be radially expanded by a hydraulic activating system.

9. The system of claim 4, wherein, the radial expansion means comprises a mandrel formed of a plurality of radially movable mandrel segments and the mandrel is arranged to be radially expanded by a hydraulic activating system, and the hydraulic activating system comprises a fluid chamber in fluid communication with said longitudinal fluid passage during radial expansion of the mandrel.

10. The system of claim 1, wherein said string is a drill string for drilling the wellbore.

11. A method of lining a section of a wellbore with an expandable tubular element, comprising:

drilling a section of the wellbore using a drill string;

anchoring the upper part of the expandable tubular element in the wellbore using an anchoring means;

releasing the drill string from the expandable tubular element; and pulling an expander by means of the drill string through the expandable tubular element so as to radially expand the expandable tubular element.

* * * * *